US006202326B1

(12) United States Patent
Hauglin

(10) Patent No.: US 6,202,326 B1
(45) Date of Patent: Mar. 20, 2001

(54) SOLE FOR A CROSS-COUNTRY, TRAIL OR TELEMARK SKI-BOOT

(75) Inventor: Bernt-Otto Hauglin, Røyken (NO)

(73) Assignee: Róttefella AS, Klokkarstua (NO)

( * ) Notice: Subject to any disclaimer, the term of this patent is extended or adjusted under 35 U.S.C. 154(b) by 0 days.

(21) Appl. No.: 09/230,269

(22) PCT Filed: Jul. 18, 1996

(86) PCT No.: PCT/IB96/00725

§ 371 Date: Jun. 14, 1999

§ 102(e) Date: Jun. 14, 1999

(87) PCT Pub. No.: WO98/03093

PCT Pub. Date: Jan. 29, 1998

(51) Int. Cl.[7] ..... A43B 5/04
(52) U.S. Cl. ..... 36/117.2; 36/117.3; 36/30 R
(58) Field of Search ..... 36/117.2, 117.3, 36/25 R, 30 A, 31, 30 R

(56) References Cited

U.S. PATENT DOCUMENTS 3,613,270 * 10/1971 Eie ..... 36/117.3
4,186,500 * 2/1980 Salzman ..... 36/117.2
4,907,353 * 3/1990 Wittmann et al. ..... 36/117.2

FOREIGN PATENT DOCUMENTS 0 243 847 11/1987 (EP) .
2 457 081 12/1980 (FR) .
2 595 951 9/1987 (FR) .
WO 96/23558 8/1996 (WO) .

* cited by examiner

*Primary Examiner*—M. D. Patterson
(74) *Attorney, Agent, or Firm*—Knobbe, Martens, Olson & Bear, LLP

(57) ABSTRACT

Sole for a cross-country, touring or Telemark ski shoe the front section of which comprises, for the purpose of binding a shoe of this type onto a cross-country, touring or Telemark binding between ball area and rear end, in particular at its rear end, means for engaging a clamping element so that the front sole section can be clamped between its front definition and the aforementioned engaging means. Into the front section of the sole is embedded a reinforcing element. The latter extends between the front definition of the sole and the engaging means for the clamping element in such a manner that the resulting tensional load vector lies above the zero line of the reinforcing element, which extends approximately parallel thereto.

18 Claims, 4 Drawing Sheets

FIG. 4
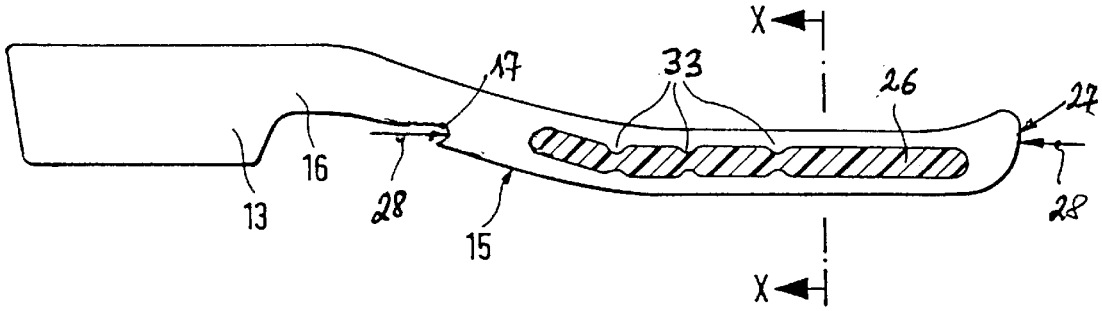
FIG. 5
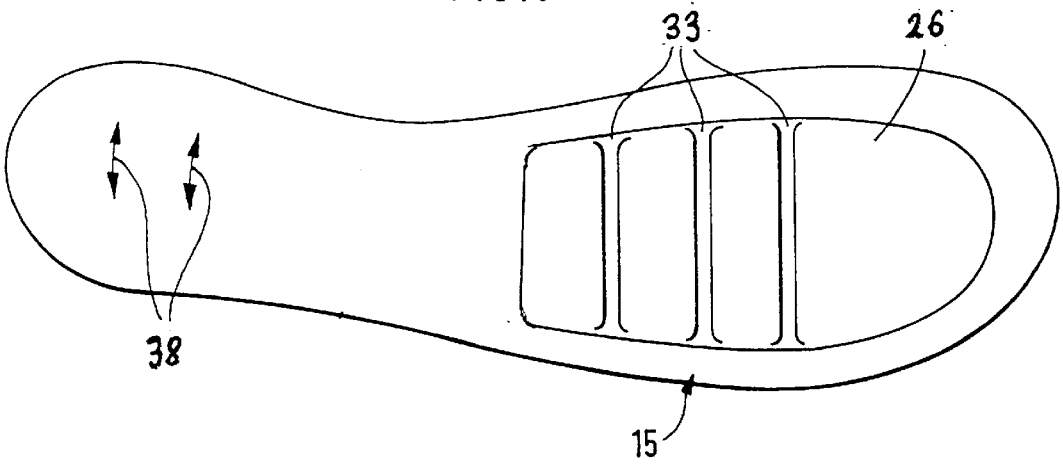
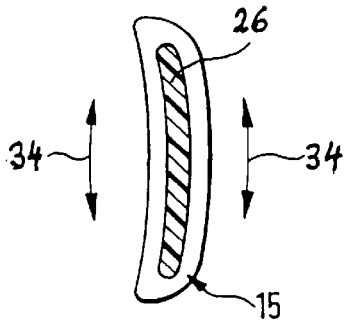
FIG. 6

SOLE FOR A CROSS-COUNTRY, TRAIL OR TELEMARK SKI-BOOT

FIELD OF THE INVENTION

The invention relates to a sole for a cross-country, touring or Telemark ski shoe the front section of which comprises, for the purpose of binding a shoe of this type onto a cross-country, touring or Telemark binding between ball area and rear end, in particular at its rear end, means for engaging a clamping element so that the front sole section can be clamped between its front definition and the aforementioned engaging means, and into which is embedded or mounted a flexurally elastic reinforcing element.

BACKGROUND OF THE INVENTION

A sole structure of this type has been suggested in the previous PCT/IB96/00085 of the applicants. This pre-application deals actually with binding a ski shoe to an associated ski binding by a clamping element which engages at the front sole of the shoe, in particular between ball area and its rear end. The clamping element preferably engages the bottom side of the front sole of the shoe. In a first form of embodiment, the clamping element is arranged around a clamping cord which is taken around at least a portion of the front sole. A second alternative form of embodiment is characterised in that the clamping element is designed as an elastic band or springleaf the rear end of which can be hooked into the bottom side of the front sole of the shoe. These aforementioned designs permit unhindered lifting of the shoe heel during cross-country or touring skiing. Furthermore, this design ensures defined reshaping of the shoe or the sole of the shoe, so that the guidance of skis and a load transfer onto the ski do not suffer and a maximum portion of energy offered by the skier can be converted into speed and guidance of skis.

SUMMARY OF THE INVENTION

Based on these initial thoughts, it is an object of the present invention to design the sole structure in such a manner that the aforementioned effects can be promoted further and are in particular ensured. To be particularly ensured is the defined downward curvature of the front sole sections or the front sole when the heel of the shoe is lifted during cross-country, touring or Telemark skiing. In this context, it may be mentioned that embedding or mounting a flexurally elastic reinforcing element offers the advantage that the sole can then be made of soft elastic plastic or rubber. Use of such a material allows a reduction of the overall weight of the sole and accordingly of the shoe itself.

The aforementioned aims are achieved according to the invention by a sole for a ski having a front section, a rearwardly open back taper and a flexurally elastic reinforcing element. The front section binds the ski shoe onto a ski binding. The rearwardly open back taper engages with a clamping element for clamping the front section between a front definition of the sole and the back taper. The reinforcing element is embedded into the front section and forked into two fork shanks in proximity of the back taper so that both fork shanks extend into an upper definition and a lower definition of the back taper. Further, the reinforcing element extends between the front definition of the sole and the back taper in such a manner that a tensional load vector, which results from clamping the front section, lies above a zero level of the reinforcing element, and which extends approximately parallel thereto.

Accordingly, the inventive sole design distinguishes itself in that the reinforcing element extends in the front section of the sole between its front definition and the engaging means for the clamping element in such a manner that the resulting tensional load vector lies above the zero line of the reinforcing element, which extends approximately parallel thereto. The tensional force vector extends, on the one hand, on the connecting line between the support of the front definition of the sole on the binding or on the binding housing and, on the other hand, on the engagement of the clamping element in the rear area of the front sole section. This connecting line should be positioned above the zero or gravity force line of the reinforcing element, which extends in the longitudinal direction of the sole. It has to be pointed out that the aforementioned zero or gravity force line is not necessarily in a straight line. It can also be arched if the reinforcing element is correspondingly bent or curved in the longitudinal direction of the sole. In this case, the tensional load vector defines a chord of this arched line. As regards this special form of embodiment, reference is made to claim 2. In this form of embodiment, the reinforcing element is a surface component of corrosion-resistant material, in particular aluminium, precious steel, plastic, titanium alloy or the like. The component has a specified downward curvature and is mounted, whilst maintaining said curvature, into the front section of the sole in such a manner that the tensional load vector defines a chord of the zero line of the downwardly curved reinforcing element. The given curvature of the reinforcing element does not have to be particularly marked. It only serves to ensure that the front section of the sole is pretensioned downwards rather than upwards when clamping the sole or the shoe into the binding. This guarantees that the front sole section behaves anatomically when the heel is lifted.

The reinforcing element can alternatively be designed as a wire insert.

It is also feasible to design the reinforcing element with at least one hinge area in the direction parallel to the sole and approximately vertically to its longitudinal direction.

The reinforcing element is preferably designed as a plate- or foil-like insert of metal or plastic. In this case, the hinge area is characterised by a material weakening and/or beading.

The reinforcing element is preferably directly adjacent the engaging means for the clamping element on the sole so as to ensure firm clamping in the event of particularly soft sole material.

In a preferred form of embodiment, the sole-integrated engaging means for the clamping element include a rearwardly open back taper which is formed on the bottom of the front sole section and into which is insertible a clamping cord or a clamping hook which is pretensionable when closing the binding in the forward direction.

For the purpose of strengthening the aforementioned connecting point for the clamping element, the reinforcing element is preferably forked in the area of the back taper, i.e. in such a manner that both fork shanks extend into the upper and lower definition of the back taper.

A particularly advantageous form of embodiment is further characterised in that the thickness of the reinforcing element decreases from rear to front. This achieves, on the one hand, a particularly high strength in the engaging and linking area and, on the other hand, high flexibility of the front sole section.

BRIEF DESCRIPTION OF THE DRAWINGS

Preferred forms of embodiment of an inventive sole structure will now be described in more details, based on the attached drawing. Shown are, in FIG. 1: a shoe fitted with an inventive sole which is clamped into a corresponding cross-country ski binding, in a side view;

FIGS. 4–6: a further form of embodiment of a sole designed according to the invention, in a top view, whilst illustrating the reinforcing element, and cross-sectionally longitudinal line X—X in FIG. 4;

DETAILED DESCRIPTION OF THE INVENTION

Figure 1:
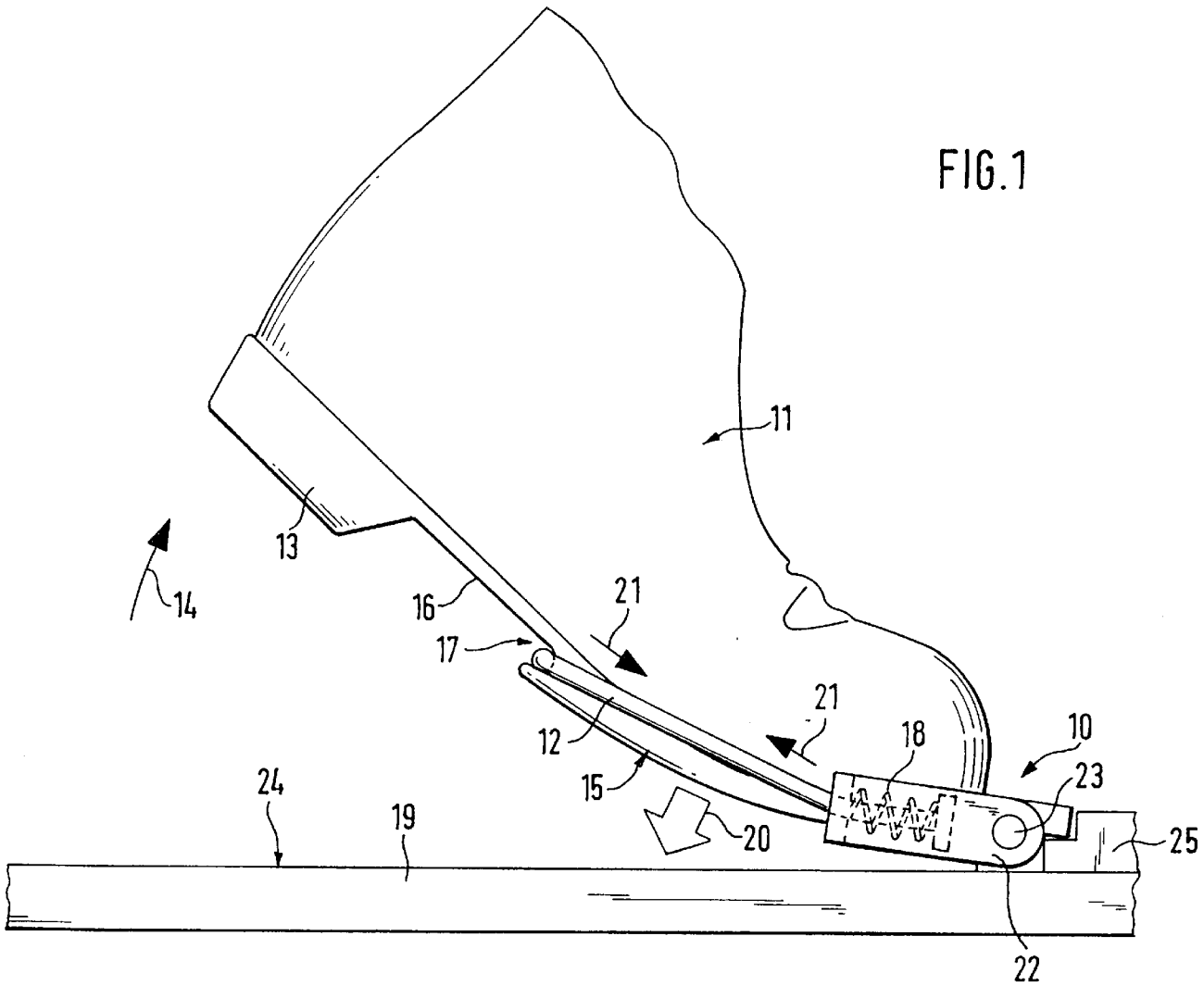

In FIG. 1 is shown in a diagrammatic side view a combination of ski binding 10, i.e. touring or Telemark binding, and a thereto fitted shoe 11 the front end of which is held in binding 10 by a spring-elastically pretensioned tension cord 12 in such a manner that heel 13 of shoe 11 can be lifted freely, i.e. in the direction of arrow 14. Clamping cord 12 is joined at the front sole section or at front sole 15 of shoe 11, i.e. at the rear end of the front sole. Alternatively, it is feasible to join in the ball area or between the ball area and the rear end of the front sole. Actually, a back taper 17 is provided in the transitional area between front sole 15 and middle area 16 of the sole, which extends parallel to the sole and transversely to the longitudinal direction of the sole and into which clamping cord 12 can be hooked whilst respectively fixing the sole or shoe 11 on binding 10. Clamping cord 12 is elastically pretensioned by a helical spring 18 which is only outlined in FIG. 1. Shoe heel 13 is lifted in the direction of arrow 14 against the load of said elastic pretensioning. Front sole 15 then curves as in FIG. 1 between its front and rear end downwards in the direction of arrow 20 toward ski body 19. This curvature corresponds with the bending of the front of the foot when lifting shoe heel 13. It is therefore anatomically and in particular also ergonomically advantageous. This curvature is supported by spring-elastic pretensioning of tension cord 12 in the direction of arrows 21, and equivalent clamping elements can be provided in place of a clamping cord, for example a flexurally elastic leafspring as described in the PCT/IB96/00085.

The front end of shoe 11, in particular the front end of front sole 15, is held in a support jaw 22 and supported both towards the side, the front and the top. Support jaw 22 is hinged onto the top of the aforementioned ski body 19, and transverse axis 23 extends parallel to ski cover surface 24 as well as transversely to the longitudinal direction of the ski. The hinge axis is mounted in a binding housing 25, which is not described in detail and which is firmly connected to ski body 19. A flexor (not illustrated in detail), which assists return positioning of the shoe from the lifting position as in FIG. 1 onto ski cover surface 24, can be operational between support jaws 22 and binding housing 25. The flexor design is generally known so that a closer illustration and description can be dispensed with.

Figure 2:
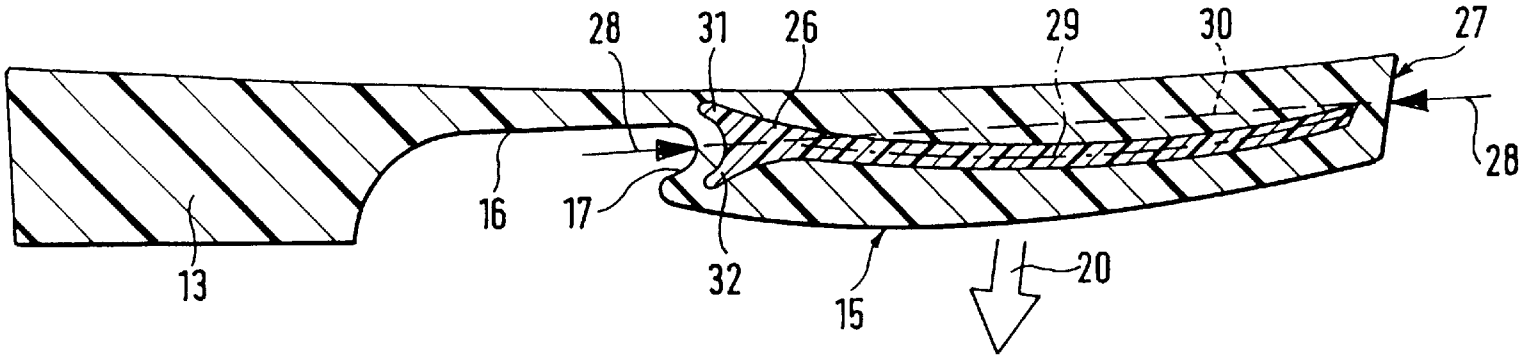
FIG. 2: a first form of embodiment for an inventive sole, in a longitudinal cross-section.

In FIG. 2 is illustrated in a longitudinal view a sore for a shoe according to FIG. 1. Into the front section of this sole is embedded or mounted a flexurally elastic reinforcing element 26. This reinforcing element 26, which is preferably designed in the form of a plate or foil and made of a comparatively hard material, in particular metal or plastic, extends between front definition 27 of the sole and back taper 17, which serves to engage the abovementioned clamping element 12, i.e. in such a manner that the resulting tensional load vector 28 lies above zero line 29 of reinforcing element 26, which extends approximately parallel thereto. Reinforcing element 26 is then in a predetermined manner downwardly curved and embedded in front sole section 15 so that tensional load vector 28 defines a chord 30 of zero line 29 of the downwardly curved reinforcing element 26. This ensures the curvature, as previous described based on FIG. 1, of the front sole section or front sole 15 in the direction of arrow 20 during operation.

Reinforcing element 26 extends virtually over the entire length and width of the front sole section or front sole 15.

Figure 3:
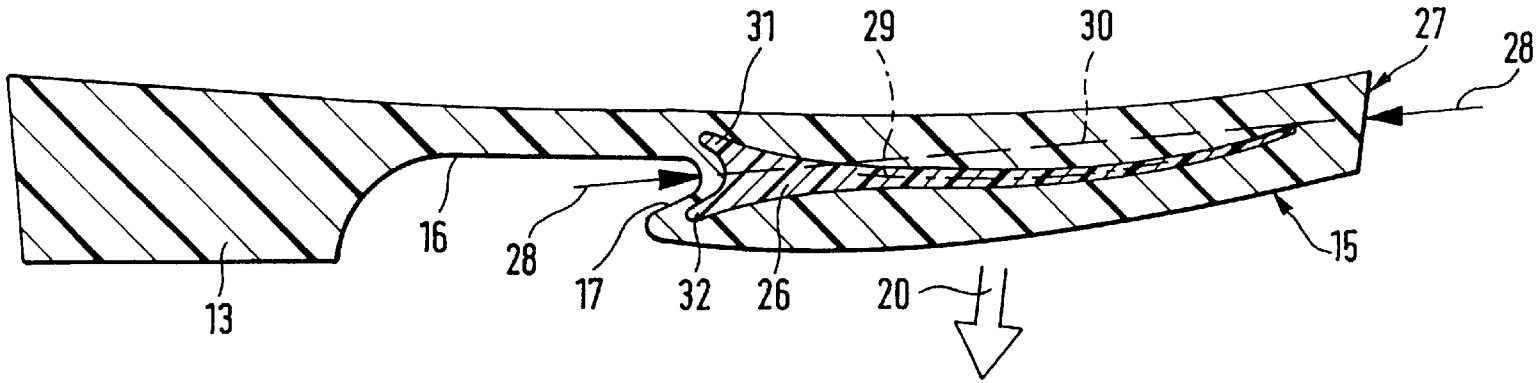
FIG. 3: a second form of embodiment of a sole designed according to the invention, in a longitudinal cross-section.

In the form of embodiment of FIG. 3, the thickness of reinforcing element 26 reduces from the rear to the front. This guarantees high strength in the area of back taper 17, i.e. in the connecting area for the clamping element, for example clamping cable 12 as in FIG. 1; furthermore, front sole 15 is increasingly flexible in a forward direction. This offers high user comfort.

Furthermore, the forms of embodiment of FIGS. 2 and 3 distinguish each other in that the reinforcing element is forked in the area of back taper 17 in such a manner that both fork shanks 31, 32 extend into the upper and lower definition of back taper 17. This form of embodiment contributes towards additional strength of back taper 17, i.e. of the connecting area for the clamping element.

The flexibility of reinforcing element 26 can be influenced by further measures, for example by measures as in FIGS. 4 to 6 where the sole is reinforced in the front section by a foil-like insert 26. Actually, this is a hard-elastic plastic insert which is embedded into an otherwise substantially softer sole material. The sole is preferably composed of very weather-resistant and flexural rubber. The use of this material is preferred for soles of touring and Telemark shoes. Insert 26 offers the sole, and thus the entire shoe, increased lateral and torsional stability as is indicated by double arrows 34 in FIG. 6. The flexibility of the sole in the longitudinal direction of the shoe or in a vertical plane extending in the longitudinal direction of the shoe is not impeded by insert 26, in particular when it includes at least one hinge area in the direction parallel to the sole and approximately vertical to the longitudinal axis of the shoe. In the present case, three hinge areas 33 are provided which are configured in the ball area at a predetermined distance from each other. Actually, hinge areas 33 are defined by beading on both sides.

Figure 7:
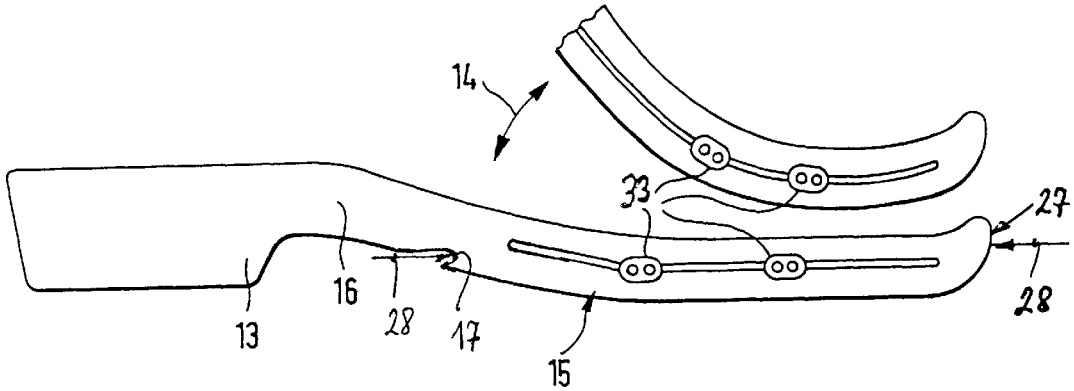
FIGS. 7–8: a further modified form of embodiment for a sole designed according to the invention, in a diagrammatic longitudinal cross-section as well as a diagrammatic top view, whilst illustrating the modified reinforcing element.
Figure 8:
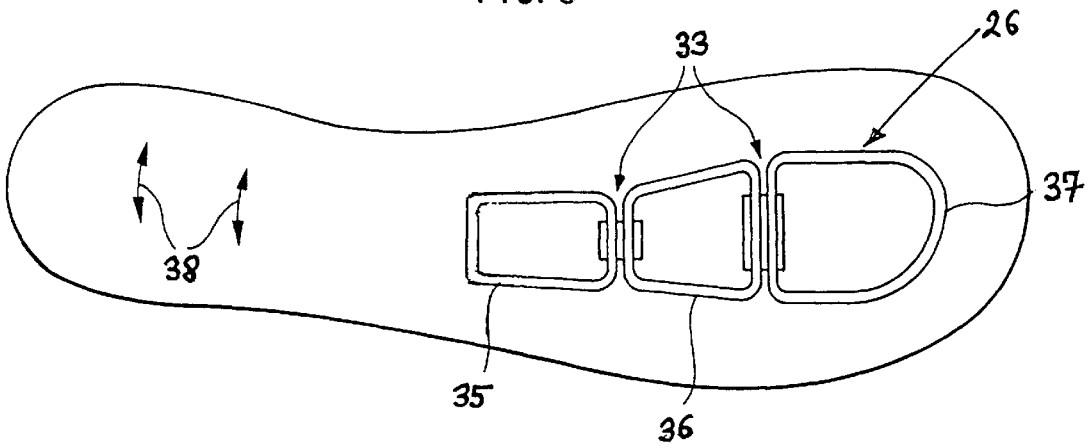

Alternatively, a metal wire insert as in FIGS. 7 and 8 is possible, and three metal wire rings 35, 36, 37 as in FIG. 8 are provided which are interconnected in she ball area whilst forming hinges, which extend parallel with the sole and transversely to the longitudinal direction of the soles or hinge areas 33. Lateral stability of the sole obtained by the described inserts is indicated by double arrows 38 in FIGS. 5 and 8. Inserts 26 then affect in particular the lateral stability of the rear half of the shoe sole or of the shoe.

The aforedescribed sole design produces a very defined flexibility which is of particular significance to Telemark shoes. Furthermore, this sole design is also advantageous in a combination with the type of binding described based on FIG. 1 as clamping of the shoe is performed exclusively in the area of front sole 15. There, the sole has to be particularly firm without losing the flexibility in the vertical plane extending parallel to the longitudinal direction of the shoe. In particular, it is also guaranteed that flexibility in a downward direction, i.e. towards the footprint side of the sole, is given.

All features revealed in the application documents are claimed as essential to the invention as long as they are individually or in a combination new with respect to the prior art.

List of Reference Marks

| | |
|---|---|
| 10 | Ski Binding |
| 11 | Shoe |
| 12 | Clamping Cord |
| 13 | Heel |
| 14 | Arrow |
| 15 | Front Sole Section (Front Sole) |
| 16 | Middle Area |
| 17 | Back Taper |
| 18 | Spring |
| 19 | Ski Body |
| 20 | Arrow |
| 21 | Arrow |
| 22 | Support Jaws |
| 23 | Hinge Axis |
| 24 | Ski Cover Surface |
| 25 | Binding Housing |
| 26 | Reinforcing Element |
| 27 | Front Definition of Sole |
| 28 | Tension Load Vector |
| 29 | Zero Line |
| 30 | Chord |
| 31 | Fork Shank |
| 32 | Fork Shank |
| 33 | Hinge Area |
| 34 | Double Arrow |
| 35 | Metal Wire Ring |
| 36 | Metal Wire Ring |
| 37 | Metal Wire Ring |
| 38 | Double Arrow |

What is claimed is:

1. A sole for a ski shoe, comprising:

a front section having a front end and a rear end, wherein the rear end tapers so as to form a surface for engaging a clamping element for clamping the front section of the sole to a ski binding; and a flexurally elastic reinforcing element which extends between the front end and the rear end of the front section, and is divided at a rear end into two portions, one of the two portions extending upward and the other extending downward, and which is downwardly curved so that a tensional load vector defines a chord of a correspondingly curved zero line of the reinforcing element.

2. The sole of claim 1, wherein the reinforcing element is made of a corrosion-resistant material.

3. The sole of claim 2, wherein the corrosion-resistant material is a plastic material.

4. The sole of claim 2, wherein the corrosion resistant material is a metal.

5. The sole of claim 1, wherein the reinforcing element extends substantially throughout the front section of the sole.

6. The sole of claim 1, wherein the reinforcing element is in the shape of a flat plate.

7. The sole of claim 6, wherein the reinforcing element is made of a hard-elastic plastic.

8. The sole of claim 1, wherein the front section of the sole is made of a weather-resistant and flexurally elastic rubber material.

9. The sole of claim 1, wherein the reinforcing clement has a predetermined thickness and flexural rigidity, and wherein at least one of the thickness and flexural rigidity of the reinforcing element decreases from the rear end towards the front.

10. The sole of claim 1, wherein the reinforcing element is directly adjacent the rear end of the front section of the sole.

11. A sole for a ski shoe, comprising:

a front section and a back section, the front section having a front end and a rear end, said front section being pretensioned in a downward direction, and wherein the rear end is tapered so as to form a surface for engaging a clamping element for clamping the front section of the sole to a ski binding; and a flexible reinforcing element embedded only in the front section of the sole and extending into the tapered rear end of the front section.

12. The sole of claim 11, wherein said reinforcing element is downwardly curved.

13. The sole of claim 11, wherein the sole is made of plastic.

14. The sole of claim 11, wherein the sole is made of rubber.

15. The sole of claim 11, wherein the reinforcing element is made of a material selected from the group consisting of aluminum, steel, plastic and a titanium alloy.

16. The sole of claim 11, wherein the reinforcing element has a forked rear portion.

17. The sole of claim 11, wherein the reinforcing element extends substantially throughout the front section of the sole.

18. The sole of claim 11, wherein the thickness of the reinforcing element decreases from its rear end to its front end.

* * * * *